US008460099B2

(12) United States Patent
Barclay et al.

(10) Patent No.: US 8,460,099 B2
(45) Date of Patent: Jun. 11, 2013

(54) INTEGRATING CHAT AND WAGERING GAMES

(75) Inventors: Brian J. Barclay, Atlanta, GA (US); Andrew C. Guinn, Chicago, IL (US); Richard B. Robbins, Glenview, IL (US); Richard T. Schwartz, Deerfield, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/499,064

(22) PCT Filed: Sep. 30, 2010

(86) PCT No.: PCT/US2010/051018

§ 371 (c)(1), (2), (4) Date: Mar. 29, 2012

(87) PCT Pub. No.: WO2011/041619

PCT Pub. Date: Apr. 7, 2011

(65) Prior Publication Data

US 2012/0214564 A1 Aug. 23, 2012

Related U.S. Application Data

(60) Provisional application No. 61/247,631, filed on Oct. 1, 2009.

(51) Int. Cl.
*A63F 9/24* (2006.01)

(52) U.S. Cl.
USPC ..... 463/31; 463/16; 463/20; 463/25; 463/29; 463/42

(58) Field of Classification Search
USPC ..... 463/16, 20, 25, 29, 31, 42
See application file for complete search history.

(56) References Cited

U.S. PATENT DOCUMENTS

2005/0043088 A1 2/2005 Nguyen et al.
2006/0211479 A1 9/2006 Walker et al.
2006/0287046 A1 12/2006 Walker et al.

(Continued)

FOREIGN PATENT DOCUMENTS

WO WO-2011041619 4/2011

OTHER PUBLICATIONS

"PCT Application No. PCT/US10/51018 International Preliminary Report on Patentability", Oct. 24, 2011 , 5 pages.

(Continued)

*Primary Examiner* — Omkar Deodhar
(74) *Attorney, Agent, or Firm* — DeLizio Gilliam, PLLC

(57) ABSTRACT

A wagering game system and its operations are described herein. In some embodiments, the operations can include determining a player account logged on to a wagering game network, determining a chat session initiated by the player account via the wagering game network; and determining wagering game news events to present via a gaming chat console for the chat session. The operations can also include automatically adjusting presentation requirements for the wagering game news events based on quantifiable player factors. In some embodiments, the operations can also include presenting an interactive game bot via the gaming chat console as a social contact, receiving textual chat game commands communicated to the interactive game bot, and controlling a wagering game via the textual chat game commands. In some embodiments, the operations can also include following chat activity for the selected chat social-contact groups and integrating chat activity with client applications and devices.

22 Claims, 10 Drawing Sheets

U.S. PATENT DOCUMENTS

| | | | | |
|---|---|---|---|---|
| 2007/0015574 | A1 | 1/2007 | Vale et al. | |
| 2007/0060355 | A1 | 3/2007 | Amaitis et al. | |
| 2007/0197247 | A1 | 8/2007 | Inselberg | |
| 2008/0287180 | A1 | 11/2008 | Hutchinson-Kay | |
| 2009/0082095 | A1* | 3/2009 | Walker et al. | 463/25 |

OTHER PUBLICATIONS

"PCT Application No. PCT/US10/51018 International Search Report", Dec. 2, 2010 , 8 pages.

* cited by examiner

INTEGRATING CHAT AND WAGERING GAMES

RELATED APPLICATIONS

This application claims the priority benefit of U.S. Provisional Application Ser. No. 61/247,631 filed Oct. 1, 2009

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

TECHNICAL FIELD

Embodiments of the inventive subject matter relate generally to wagering game systems and networks that, more particularly, integrate chat and wagering games.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and play wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross jurisdictional restrictions and requirements. Further, some online casinos have struggled adapting the online gaming industry to a traditionally non-wagering game business environment. As a result, wagering game manufacturers, casino operators, and online game providers are constantly in need of innovative concepts that can make the online gaming industry appealing and profitable.

SUMMARY

In some embodiments, a computer-implemented method comprises determining a pre-set news threshold requirement value, which indicates a requirement that a gaming event must comply with before being announced in a news message via a gaming chat console, wherein the gaming event occurs in a wagering game on a wagering game network; determining a player-related statistical value for one or more player accounts logged on to the wagering game network; dynamically adjusting the pre-set news threshold requirement value to a modified news threshold requirement value based on the player-related statistical value; comparing an event value associated with the gaming event to the modified news threshold requirement value; determining that the event value complies with the modified news threshold requirement value; and presenting the news message via the gaming chat console because the event value complies with the modified news threshold requirement value.

In some embodiments, the player-related statistical value is related to a statistical betting average for the one or more player accounts.

In some embodiments, dynamically adjusting the pre-set news threshold requirement value comprises determining that the player-related statistical value complies with a pre-determined statistical metric, determining a news threshold modifier value assigned to the pre-determined statistical metric, and adjusting the pre-set news threshold requirement value using the news threshold modifier value.

In some embodiments, the gaming event is a wagering game win, the event value is a wagering game win amount, the pre-set news threshold requirement value is a win amount threshold required for the wagering game win to merit being announced in the news message, and further comprises: determining a news threshold modifier value, which specifies a degree of modification for the win amount threshold; modifying the win amount threshold by the degree of modification specified by the news threshold requirement value; generating a modified win amount threshold value as a result of modifying the win amount threshold; and comparing the wagering game win amount to the modified win amount threshold value.

In some embodiments, the computer-implemented method comprises determining that a first player account and a second player account are assigned the pre-set news threshold requirement value when the first player account and the second player account logon to the wagering game network; determining a first player-related statistical value based on a first playing history for the first player account; determining that the first player-related statistical value does not exceed the pre-set news threshold requirement value; presenting the news message to the first player account, via an instance of the gaming chat console associated with the first player account; determining a second player-related statistical value based on a second playing history for the second player account; determining that the second player-related statistical value exceeds the pre-set news threshold requirement value; assigning the modified news threshold requirement value to the second player account; and suppressing presentation of the news message to the second player account.

In some embodiments, the modified news threshold requirement value either increases or decreases a news message presentation rate via the gaming chat console, and further comprises referring to the player account; and determining, from the player account, a player preference for either increasing or decreasing the news message presentation rate.

In some embodiments, one or more machine-readable media having instructions stored thereon, which when executed by a set of one or more processors causes the set of one or more processors to perform operations comprises connecting an interactive game chat bot with a wagering game player account via a gaming chat session; receiving a textual game command, for a wagering game, from the wagering game player account, via the gaming chat session; initiating a wagering game session with the wagering game player account; activating a wagering game round according to the textual game command; determining a wagering game outcome for the wagering game round; generating a textual outcome message of the wagering game outcome; and transmitting the textual outcome message to the wagering game player account, via the gaming chat session, as a chat communication from the interactive game chat bot.

In some embodiments, the textual game command includes special characters representative of a specific wagering game function, and the operations further comprises deciphering the special characters as an instruction to perform the specific wagering game function; and performing the specific wagering game function.

In some embodiments, the specific wagering game function comprises one or more of a reel spin function, a spin repeat function, a game bet function, a bet multiplication function, a card split function, a card fold function, a cash-in function, a cash-out function, and a game quit function.

In some embodiments, the operations further comprise referring to the wagering game player account to decipher the special characters.

In some embodiments, the operation for activating the wagering game round includes operations further comprises determining a bet value associated with the wagering game player account; and electronically transacting the bet for the wagering game player account with a wagering game account server.

In some embodiments, the textual outcome message includes graphical emoticons that represent game play elements.

In some embodiments, a system comprises a client device configured to present a chat client on a computer, initiate a chat session via the chat client for a chat user account associated with the chat client, receive a textual chat command, via the chat session, directed to a chat social contact that represents a wagering game, and transmit the textual chat command, via the chat session, to the chat social contact. The system also includes a wagering game server configured to receive the textual chat command, initiate a wagering game session with a player account associated with the chat user account, transact a wager for the player account for the wagering game, control a function of the wagering game using the textual chat command, determine a wagering game outcome for the wagering game, generate a textual response of the wagering game outcome, and transmit the textual response of the wagering game outcome to the chat user account via the chat session.

In some embodiments, the client device further comprises a keystroke tracker configured to determine a key stroke and generate the textual chat command based on the key stroke.

In some embodiments, the wagering game server further comprises a chat controller configured to present and control a chat bot that emulates a social contact for the chat client, and communicate game activity with the client device via the chat bot.

In some embodiments, the wagering game server further comprises a news provider configured to control presentation of wagering game news events via the chat client, and automatically adjust presentation requirements for news events based on quantifiable player factors In some embodiments, an apparatus comprises a gaming chat module configured to present a chat console associated with a network gambling venue, wherein the chat console includes a group of chat social contacts associated with a player account, wherein the player account is associated with a wagering game account server, determine a selected chat social contact selected via the chat console, assign the selected chat social contact as a member of a followed group, wherein the followed group is a collection of additional player accounts for which the player account desires to view chat activity, determine that the selected chat social contact is engaged in a chat session within the network gambling venue, determine chat messages for the selected chat social contact sent during the chat session, and present the chat messages in the chat console for the player account, wherein the chat console is configured to present to the player account chat messages for all members of the followed group.

In some embodiments, the gaming chat module is further configured to determine that the player account is chatting in a first chat room via a chat room console, determine that the selected chat social contact is in a second chat room separate from the first chat room, wherein the selected chat social contact makes the chat messages while chatting in the second chat room, and present the chat messages for the selected chat social contact to the player account via the chat room console for the first chat room.

In some embodiments, the gaming chat module is further configured to present an option to view wagering activity for the selected chat social contact, determine an activation of the option, determine that the selected chat social contact performs wagering game activity in the network gambling venue, and present a representation of the wagering game activity via the chat console to the player account.

In some embodiments, the representation of the wagering game activity is one or more of a video replay of gaming activity for the selected chat social contact, an indicator that a pre-defined game is being played by the selected chat social contact, and an invitation to challenge the selected chat social contact in a wagering game contest.

In some embodiments, an apparatus comprises means for determining a player account logged on to a wagering game network; means for determining a chat session initiated by the player account via the wagering game network; means for determining wagering game news events to present via a gaming chat console for the chat session; means for determining player account presentation criteria regarding presentation of the wagering game news events; means for determining descriptive information associated with the wagering game news events wherein the descriptive information describes the wagering game news events; and means for modifying the presentation of the wagering game news events, via the gaming chat console, based on the player account presentation criteria and the descriptive information.

In some embodiments, the apparatus further comprises means for determining a filter included in the player account presentation criteria, wherein the filter specifies one or more types of the wagering game news events; and means for filtering the presentation of the wagering game news events based on the filter.

In some embodiments, the player account presentation criteria relates to one or more of a rate of delivery of the wagering game news events, a presentation display configuration of the wagering game news events, and a hide toggle for hiding the wagering game news events.

In some embodiments, the player account presentation criteria includes a statistical value representing a player account's wagering activity.

In some embodiments, the statistical value is one or more of a betting amount for the player account, a betting average for the player account, an amount of player status points, a degree of player activity, and a degree of player chat participation.

BRIEF DESCRIPTION OF THE DRAWING(S)

Embodiments are illustrated in the Figures of the accompanying drawings in which.

DESCRIPTION OF ILLUSTRATIVE EMBODIMENTS

Figure 1:
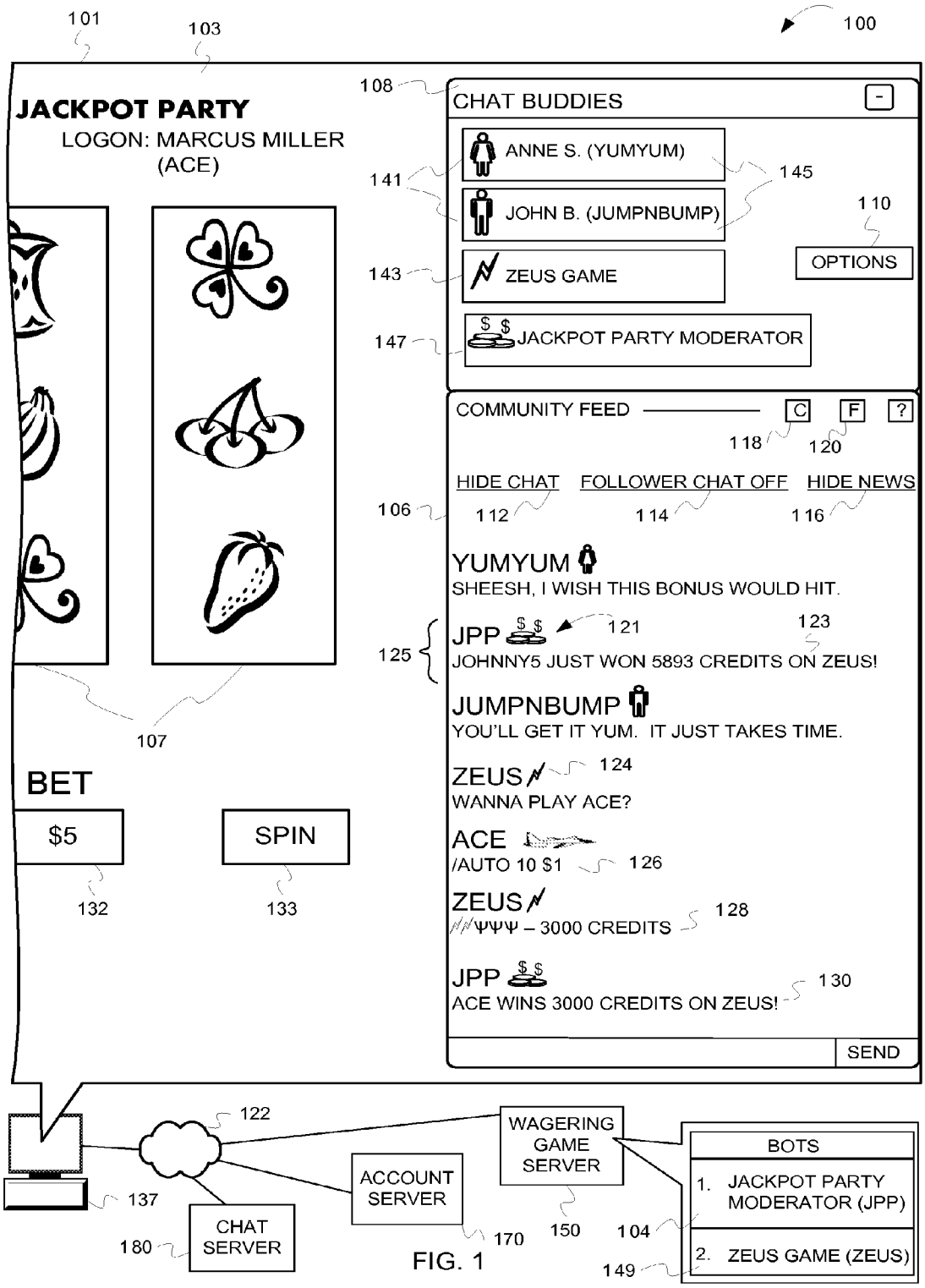
FIG. 1 is an illustration of integrating wagering games and chat, according to some embodiments.

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

Social communication is on the rise. Internet users are enjoying a proliferation of social networking mechanisms (e.g., social network websites, online chats, blogging, social network applications, etc.) that are appearing online in vast quantities. Many of those Internet users are also wagering game enthusiasts. Many wagering game enthusiasts are demanding greater access to wagering games and content related to wagering games, especially content that includes social networking Some wagering game companies have created online wagering game websites that provide a way for wagering game enthusiasts to play wagering games while connected to the Internet (e.g., via a web-browser). Some online wagering game websites provide various features, such as social network functionality. Social networks allow wagering game players ("players") to create user accounts with one or more unique identifiers that represent an online persona. One example of a unique identifier is an "avatar." Avatars are graphical, "cartoon-like" depictions of a social network persona. These online personas and associated avatars add to the fun of belonging to a social network. Many online casinos and other gaming venues, however, are constantly looking for new ways to generate innovative online, and other networked, gaming experiences.

Some embodiments of the inventive subject matter, for example, present examples of integrating chat functionality and wagering games in network gaming venues (e.g., online casinos, wagering game websites, wagering networks, etc.). Embodiments can be presented over any type of communications network (e.g., public or private) that provides access to wagering games, such as a website (e.g., via wide-area-networks, or WANs), a private gaming network (e.g., local-area-networks, or LANs), a file sharing network, a social networking network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

FIG. 1 is a conceptual diagram that illustrates an example of integrating wagering games and chat, according to some embodiments. In FIG. 1, a wagering game system ("system") 100 includes a computerized gaming client device ("client device") 137 connected to a wagering game server 150 via a communications network 122. Also connected to the communications network 122 are an account server 170 and a chat server 180. The account server 170 can host a wagering game player account. The chat server 180 can host a social network and provide chat functionality for the social network. The chat server 180 can include other devices, servers, mechanisms, etc., that provide functionality (e.g., controls, web pages, applications, etc.) that social network users can use to connect to a social-network website and utilize social-network website features (e.g., communications mechanisms, applications, etc.). In some embodiments, the chat server 180 can be combined with another server, such as the account server 170 or the wagering game server 150.

The client device 137 presents a graphical user interface ("GUI") 101 for a network wagering venue. In some embodiments, the network wagering venue is a casino network venue that presents games via wagering game machines. Thus, in some embodiments, the client device 137 can be a wagering game machine, such as the kind used in casinos, which a player can use to login via a private casino network to the player account hosted by the account server 170. In other embodiments, however, the network wagering venue can be an online casino website, or another type of wagering related website. Therefore, in some embodiments, the client device 137 can be a personal computer, a cell phone, or another personal computing device that a player uses to login via the Internet to a player account hosted by the account server 170.

A player can use the client device 137 to log on to a player account stored on the account server 170. The wagering game server 150 can communicate with the account server 170 and determine that the player account has logged in, and present, within the GUI 101, a wagering game interface 103 where the player can play wagering games. The wagering game interface 103, for example, can present playing elements of wagering games (e.g., animated slot reels 107), controls for playing and betting (e.g., a betting meter 132, a spin button 133, etc.), and features for tracking player account information (e.g., a credit meter). FIG. 1 depicts a modified view of the wagering game interface 103, which is modified to show only a portion of the animated slot reels 107 and/or other controls and features that may be presented on the wagering game interface 103.

The wagering game server 150 and the chat server 180 can work together to present a chat console 106 within the GUI 101. The chat console 106 integrates with the wagering game server 150 and the chat server 180 to present, in the chat console 106, news items that occur on the network wagering venue, such as wagering game events that occur on the wagering game server 150. For example, the wagering game server 150 can present occurrences of various game events (e.g., wins, jackpot values, etc.).

The chat console 106 can include a chat contact interface 108 (i.e., Chat Buddies). The chat contact interface 108 can include a first bot identifier ("bot identifier") 147 for a moderator bot 104 that represents the network wagering venue. The moderator bot 104 can communicate, via the chat console 106, as if it were a social contact (e.g., a chat buddy) of the player account logged in to the gambling venue. The moderator bot 104 can present news about events that occur on wagering games, such as wins, and other wagering game events. The moderator bot 104 is an example of one kind of bot. Other embodiments may use other bots that represent specific games or game features available through the gambling venue. For example, the chat contact interface 108 can include a second bot identifier ("bot identifier") 143 for a game bot 149 that represents a wagering game called "Zeus." Further, bots can present secondary services information via the chat console 106 in addition to, or in place of, wagering game events. Examples of secondary services may include game notifications, help information, advertisements, game replays, etc. Further, in some embodiments, the player account can communicate with game bots to play wagering games via the chat console 106 using textual commands typed into the chat console 106. In other embodiments, players can modify how the news is presented, both directly and indirectly. For instance, the system 100 can determine player settings that filter, arrange, or modify the presentation of news events via the chat console 106. In other embodiments, however, the system 100 can analyze player factors, such as player history, betting patterns, etc., and automatically modify the presentation of news events via the chat console 106. In some embodiments, the system 100 can also present options to follow users and aggregate chat messages, and other activity performed by the followed users, into the chat console 106. The system 100 can include a community feed control 118 and a following menu control 120. The community feed control 118, when activated, can show the community feed (i.e., the integrated chat and news feed) in the chat console 106 depicted in FIG. 1. The following menu control 120, when activated, can replace a view of the community feed and present, for example, a followers menu 540 shown in FIG. 5. Further, in some embodiments, the system 100 can detach the chat console 106 and present news events and/or provide gaming functionality such as gaming bots, followed users, etc. as a stand-alone chat client (e.g., outside of the network wagering venue) or as an integrated chat client integrated with local client applications, third-party chat software, social network websites, etc. This description will refer back to FIG. 1 in the description further below.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
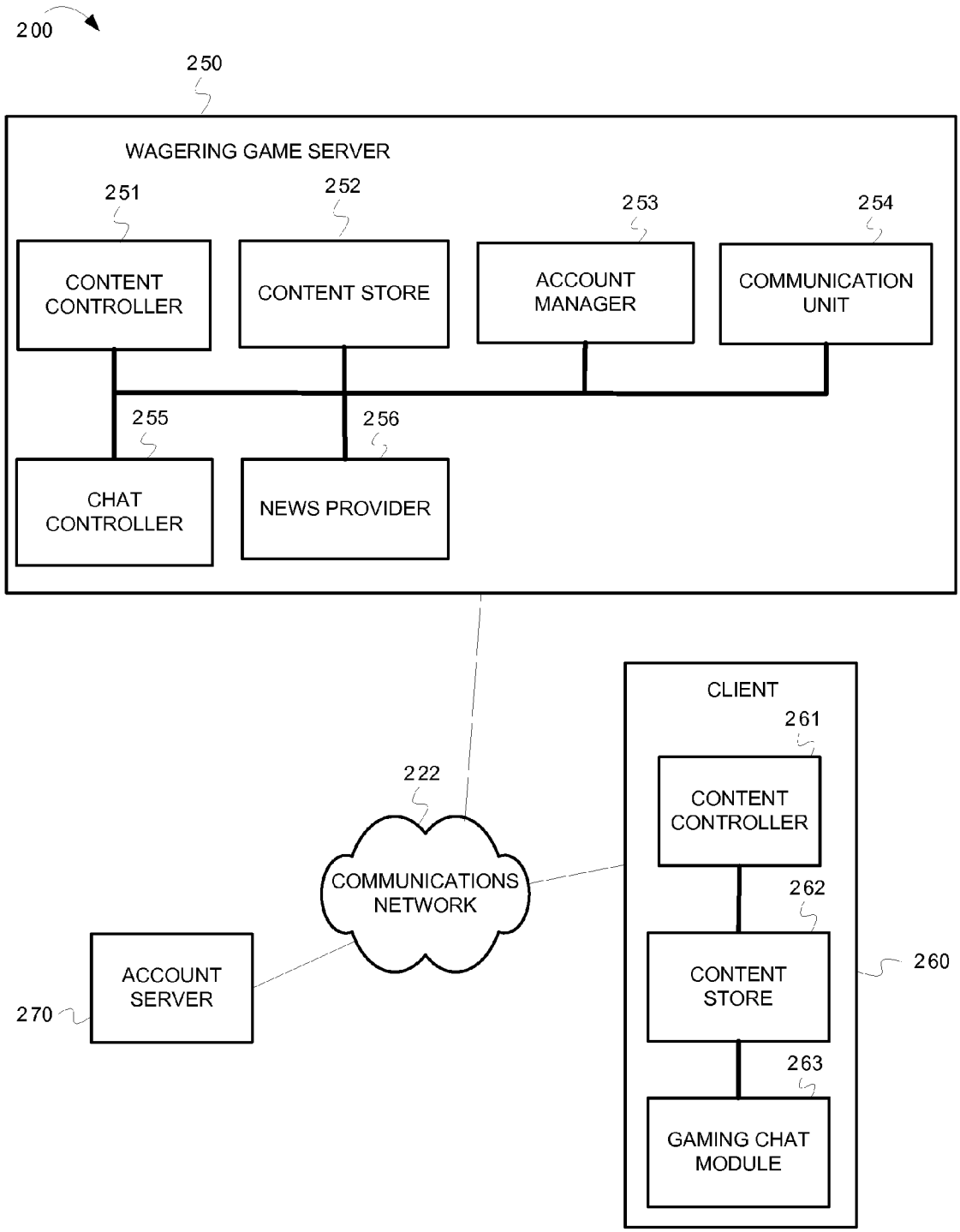
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store wagering game player account information, such as account settings (e.g., settings related to group games, settings related to social contacts, etc.), preferences (e.g., player preferences regarding presentation of gaming content in a chat console, player preferences regarding award types, preferences related to virtual assets, etc.), player profile data (e.g., name, avatar, screen name, etc.), and other information for a player's account (e.g., financial information, account identification numbers, virtual assets, social contact information, etc.). The account server 270 can contain lists of social contacts referenced by a player account. The account server 270 can also provide auditing capabilities, according to regulatory rules. The account server 270 can also track performance of players, machines, and servers.

The wagering game system architecture 200 can also include a wagering game server 250 configured to control wagering game content, provide random numbers, and communicate wagering game information, account information, and other information to and from the client 260. The wagering game server 250 can include a content controller 251 configured to manage and control content for the presentation of content on the client 260. For example, the content controller 251 can generate game results (e.g., win/loss values), including win amounts, for games played on the client 260. The content controller 251 can communicate the game results to the client 260. The content controller 251 can also generate random numbers and provide them to the client 260 so that the client 260 can generate game results. The wagering game server 250 can also include a content store 252 configured to contain content to present on the client 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the client 260 and to communicate with other systems, devices and networks. The wagering game server 250 can also include a chat controller 255 configured to present and control chat bots that emulate social contacts via chat. The chat controller 255 can also be configured to receive chat text commands and control wagering games using the chat text commands. The chat controller 255 can also present and control following functionality for selected chat social-contacts associated with a player account. The wagering game server 250 can also include a news provider 256 configured to control presentation of wagering game news events via gaming chat consoles. The news provider 256 can also be configured to automatically adjust presentation requirements for news events based on quantifiable player factors.

The wagering game system architecture 200 can also include the client 260 configured to present wagering games and receive and transmit information to integrate chat and wagering games. The client 260 can be a computer system, a personal digital assistant (PDA), a cell phone, a laptop, a wagering game machine, or any other device or machine that is capable of processing information, instructions, or other data provided via a communications network 222. The client 260 can include a content controller 261 configured to manage and control content and presentation of content on the client 260. The client 260 can also include a content store 262 configured to contain content to present on the client 260. The client 260 can also include a gaming chat module 263 configured to control wagering games and chat on the client 260.

Each component shown in the wagering game system architecture 200 is shown as a separate and distinct element connected via the communications network 222. However, some functions performed by one component could be performed by other components. For example, the wagering game server 250 can also be configured to perform functions of the gaming chat module 263, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the client 260 instead of, or in addition to, being a part of the wagering game server 250. Further, in some embodiments, the client 260 can determine wagering game outcomes, generate random numbers, etc., instead of, or in addition to, the wagering game server 250.

As mentioned previously, in some embodiments, the client 260 can take the form of a wagering game machine. Examples of wagering game machines can include floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, clients and wagering game servers work together such that clients can be operated as thin, thick, or intermediate clients. For example, one or more elements of game play may be controlled by the client or the wagering game servers (server). Game play elements can include executable game code, lookup tables, configuration files, game outcome, audio or visual representations of the game, game assets, or the like. In a thin-client example, the wagering game server can perform functions such as determining game outcome or managing assets, while the clients can present a graphical representation of such outcome or asset modification to the user (e.g., player). In a thick-client example, the clients can determine game outcomes and communicate the outcomes to the wagering game server for recording or managing a player's account.

In some embodiments, either the client or the wagering game server(s) can provide functionality that is not directly related to game play. For example, account transactions and account rules may be managed centrally (e.g., by the wagering game server(s)) or locally (e.g., by the client). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
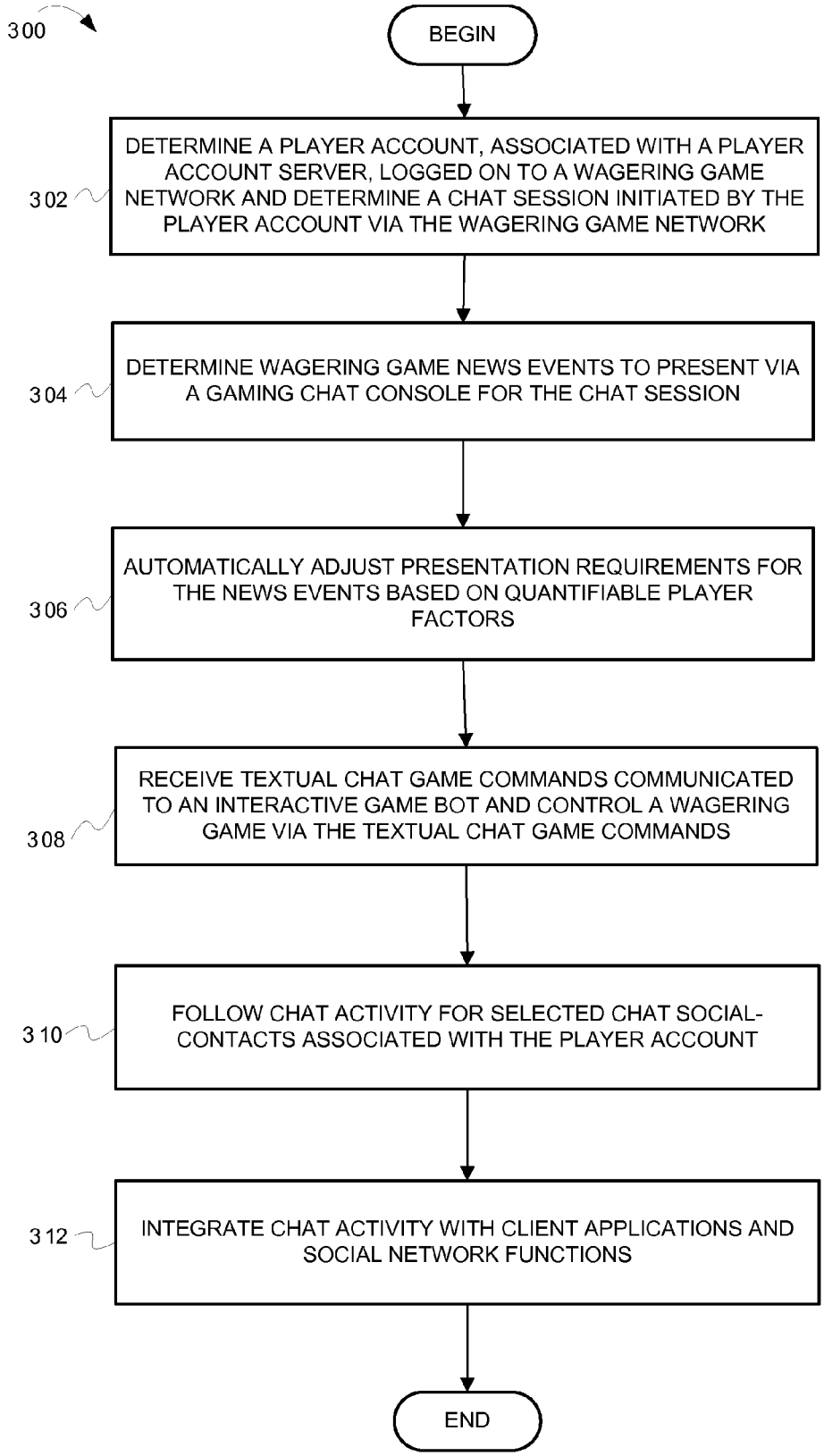
FIG. 3 is a flow diagram 300 illustrating integrating wagering games and chat, according to some embodiments.
Figure 4:
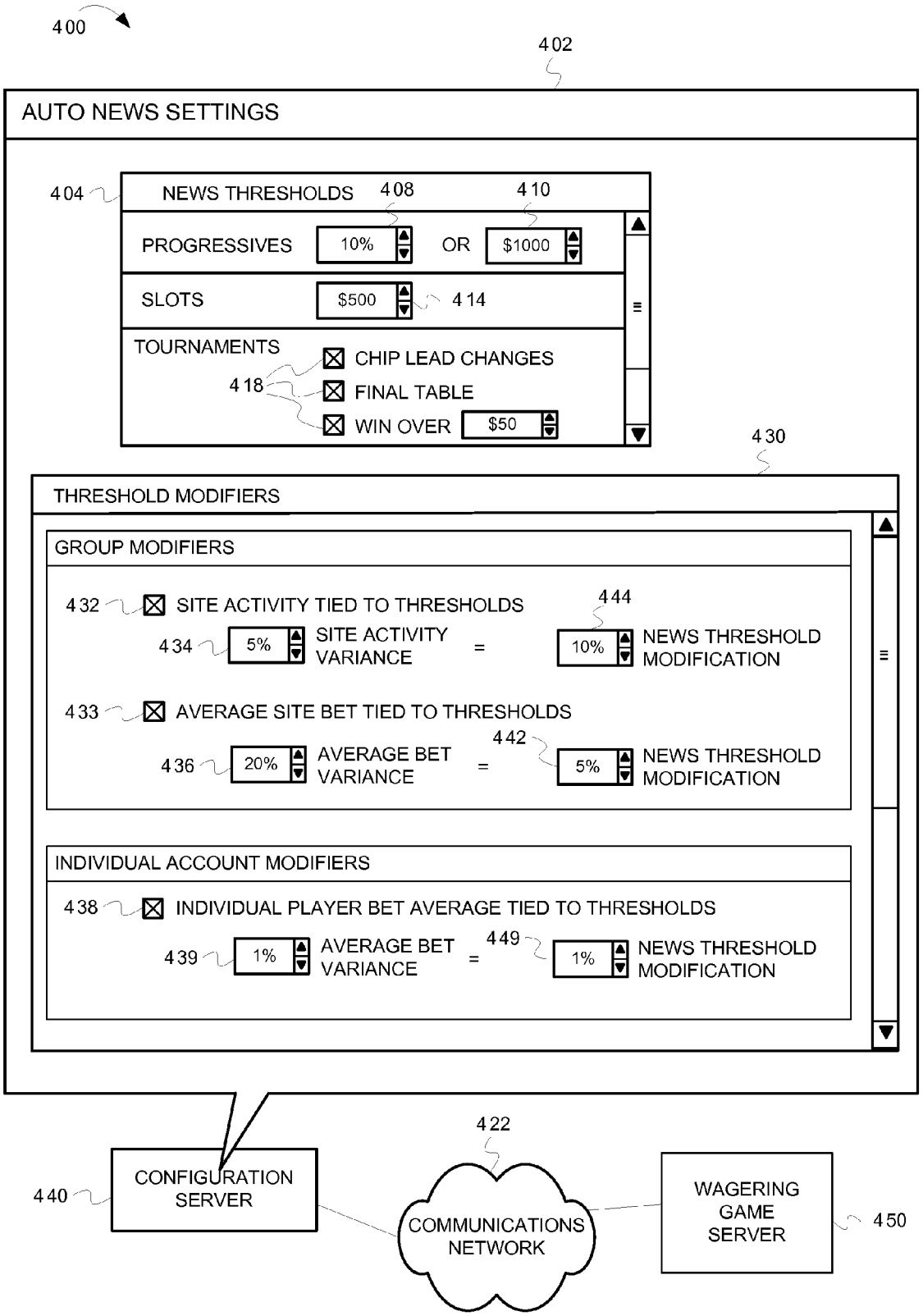
FIG. 4 is an illustration of a wagering game system 400, according to some embodiments.
Figure 5:
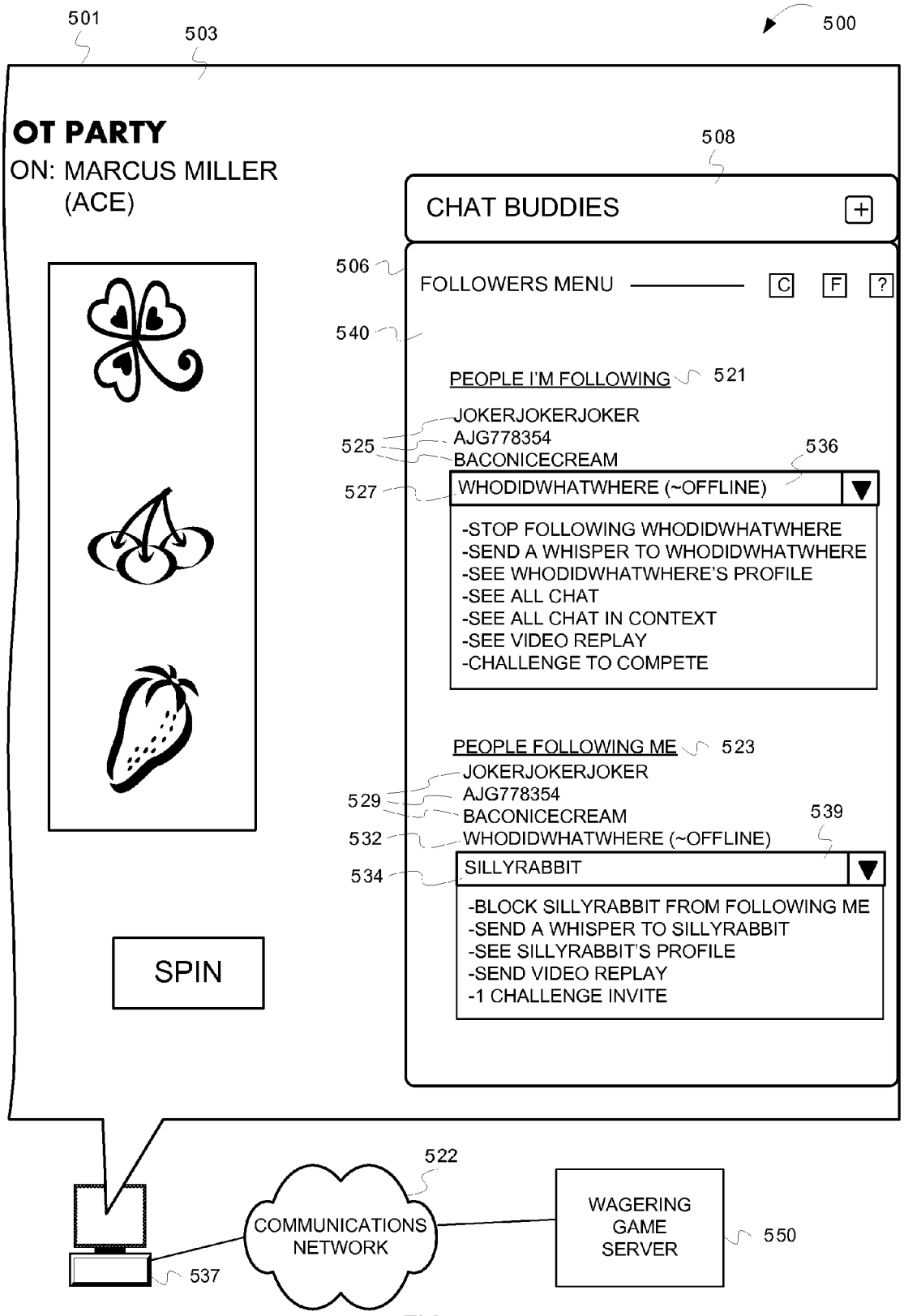
FIG. 5 is an illustration of a wagering game system 500, according to some embodiments.
Figure 6:
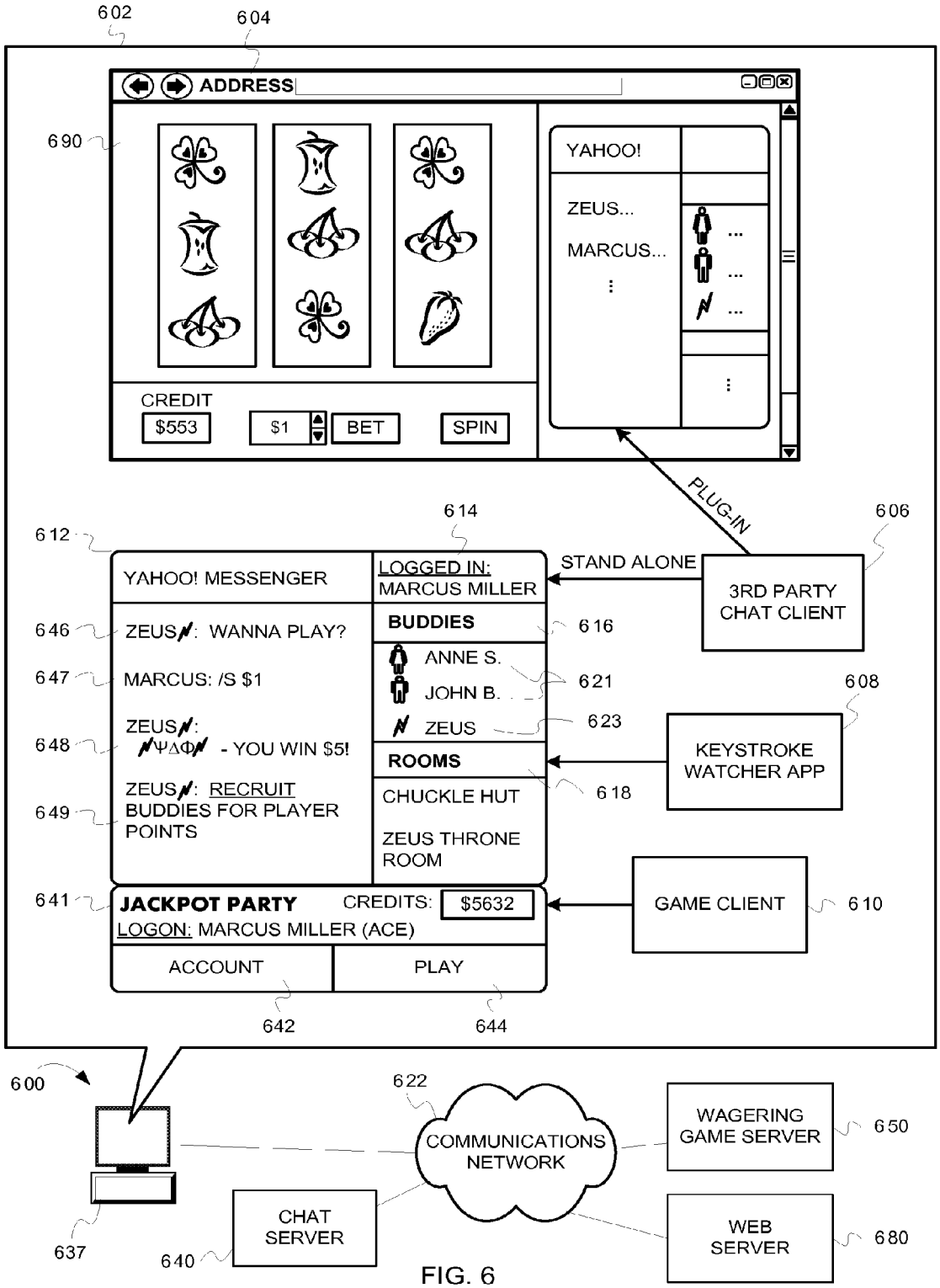
FIG. 6 is an illustration of a wagering game system 600, according to some embodiments.

FIG. 3 is a flow diagram ("flow") 300 illustrating integrating wagering games and chat, according to some embodiments. FIGS. 4, 5, and 6 are conceptual diagrams that help illustrate the flow of FIG. 3, according to some embodiments. This description will present FIG. 3 in concert with FIGS. 4, 5 and 6. In FIG. 3, the flow 300 begins at processing block 302, where a wagering game system ("system") determines a player account, associated with a player account server, logged on to a wagering game network and determines a chat session initiated by the player account via the wagering game network. For example, as shown in FIG. 1, a player account can log on to a network wagering venue presented in the GUI 101. The player account can access wagering game content presented in the wagering game interface 103 as well as social chat communications via the chat console 106. The communications via the chat console 106 can utilize the same player account information to maintain a chat session between the player account and other chat participants (e.g., other player accounts, gaming chat bots, etc.).

The flow 300 continues at processing block 304, where the system determines wagering game news events to present via a gaming chat console for the chat session. In some embodiments, the news events are related to wagering games or, in other words, wagering game news events. FIG. 1 illustrates at least one example of a wagering game news event ("news event") 125. In FIG. 1, the moderator bot 104 can present notifications of when a player has won a high number of credits (i.e., a number of win credits that meet a pre-defined newsworthiness news threshold value). The news event 125 includes a message header 121 (i.e., the "JPP" initials and an avatar for the moderator bot 104), which identifies the moderator bot 104 and makes the moderator bot 104 appear to be a chat contact that presents a chat message 123. The chat message 123 indicates that a player (e.g., Johnny5, which in this case is a player different from the logged in player Marcus Miller/"Ace") has won a high number of credits for the wagering game named "Zeus."

The chat contact interface 108 (i.e., the "Chat Buddies" panel) also presents social contact identifiers 141, such as avatar images, animations, photographs, etc., that represent chat social contacts 145 (e.g., Anne S. or "YumYum" and John B. or "JumpNBump") that the player has invited, or accepted invitations, to include in the chat contact interface 108. The system 100 may include options for the player to invite the moderator bot 104 to be in the chat contact interface 108. In some embodiments, however, the system 100 can invite the moderator bot 104 by default to be a chat contact. The system 100 can present the moderator bot 104 in the chat contact interface 108 using the bot identifier 147 (i.e., a name, such as "Jackpot Party Moderator," and an avatar that resembles a money graphic). In some embodiments, the player can invite other bots to be social contacts, such as the game bot 149. The system 100 can present the game bot 149 in the chat contact interface 108 using the bot identifier 143 (i.e., a name "Zeus Game" and an avatar that resembles a lightning bolt graphic, which represents a Zeus character for the Zeus game assigned to the game bot 149). The game bot 149 can also present news events and communicate with the player account via the chat console 106.

The system 100 can insert chat comments from the moderator bot 104 and the game bot 149 in stream with other chat comments by the chat social contacts 145 and/or other chat participants that are participating in chat activity via the chat console 106. The system 100 can present news related to casino-sponsored game events in a mixed delivery mode of both push and pull communications. For example, the system 100 can push game news events (e.g., the news event 125) into the chat console 106 while at the same time the chat console 106 can pull news events from other sources (e.g., other game bots, other news sources, etc.). The system 100 can present news via internal Really Simple Syndication (RSS) news feeders, XML MIME Transformation Protocol (XMTP), or other methods. In some embodiments, the system 100 can embed content in news messages. For example, the system 100 can embed a menu link into the news event 125. When a player activates the menu link, the link can bring up a menu that allows the player to replay the gaming event. The system 100 can also embed content into links for other news events that can perform other activities, such as launch a wagering game in the wagering game interface, present a profile, present past big wins, etc. Further, in some embodiments, the system 100 can present news from automated sources, such as chat bots, or from user accounts, such as from a hired moderator's user account.

The flow 300 continues at processing block 306, where the system automatically adjusts presentation requirements for the news events based on quantifiable player factors. The quantifiable player factors can be based on a group of players or on an individual player. The system can automatically adjust the presentation requirements for a group or collection of player accounts, for individual player accounts, or for both group player accounts and individual player accounts. The system can intelligently determine which news to send out based on any one or more of (though are not limited to), the following factors: player interests, player game play history, player playing schedules (e.g., times of day that players play), player locations, player personal schedules, numbers of players playing, etc. The system can refer to pre-set news-delivery threshold requirements ("news thresholds") for what constitutes an automated chat item (e.g., a win must be above a certain dollar amount threshold). The system compares the quantifiable player factors to the news thresholds to determine whether the quantifiable player factors meet, or comply with, the news thresholds.

For instance, in some embodiments, the system monitors site user activity for a wagering game website. When the wagering website slows in user activity (e.g., not as many players playing), the system can dynamically modify a "win event" dollar amount threshold, for one or more games, to have a lower value so that more win amounts are delivered as news items. On the other hand, if the wagering website is busy, the system can modify the "win event" dollar amount threshold to have a higher value, so fewer, but higher, win amounts are delivered as news items. In another example, in some embodiments, the system monitors player betting activity on the wagering game website and modifies presentation requirements based on the betting activity. For example, a news threshold can be based on an average bet for a group of players for some portion of the wagering venue (e.g., all players on the casino website, all players in a room, etc.). If the betting activity for the portion of the wagering venue is slow, for instance, the system can modify a news threshold dollar amount, for that portion of the wagering venue, to a low news threshold value (e.g., 15× the average bet). In busy times, however, the system can set the news threshold dollar amount to a high news threshold value (e.g., 25× the average bet). Instead of, or in addition to, an average bet for a portion of the wagering venue, the system can determine an average bet, coin in, or other betting activity for an individual player. For instance, if a player bets at higher bets (e.g., 30× average bet on site), then the system can automatically increase the threshold dollar amount to only show higher win news items (e.g., so that higher betting individuals only see activity of other higher betting individuals).

The quantifiable player factors, therefore, in some embodiments, are player-related statistical values (e.g., betting statistics, logon statistics, etc.) for one or more player accounts logged on to a wagering game network. The system monitors and determines the pre-set news threshold values, determines the player-related statistical values for the one or more player accounts and dynamically adjusts the pre-set news threshold values to a modified news threshold value based on the player-related statistical values.

In another embodiment, the system can compare an event value associated with a gaming event to the modified news threshold value, determine that the event value complies with the modified news threshold value and present the news message via a chat console because the event value complies with the modified news threshold value. The event, for example, can be any gaming related event that occurs, such as a win occurring on a wagering game, a progressive jackpot hitting a given level, a slot reel combination occurrence, a card combination occurrence, a chip lead change, etc. The event value is the value (numerical, relational, combination, etc.) associated with the event. Thus, examples of event values can be a win amount associated with the win, a progressive jackpot value that hits the given level, a pay-table identifier associated with the slot reel combination, a quantified description of the card combination, an indicator of the chip lead change, etc.

The system can present the news message to all user accounts logged on to a wagering game website, or only to user accounts that meet pre-determined presentation requirements. For example, the system can determine that a first player account is assigned the pre-set news threshold value. For instance, the system can determine that a player logs on during a given time period (e.g., during a busy time period on a network wagering venue). For that given time period, the system assigns the player account a pre-set news threshold value of $500 for any win, meaning that any win, from any player on the network wagering venue, that is $500 or more, during that given time period, will invoke a news event in the player's chat console. The first player account's playing activity generates a first player-related statistical value, for example, a bet average of over $1 per bet, which complies with a default betting average of $1 or more set by the system. A second player account, which also logs on during the given time period, can also be assigned the pre-set news threshold value of $500. However, the second player account's playing activity generates a second player-related statistical value, for example, a bet average of over $5 per bet. The system, however, can have a pre-set threshold modification value ("threshold modifier") that is related to average bet activity that indicates that if any player's average bet exceeds $5 per bet, then the system will automatically modify the pre-set news threshold value. In this particular example, therefore, the second player's average bet is over $5 per bet and the system can modify the pre-set news threshold value, for the second player account, to be a modified news threshold value. For instance, the system can modify the default $500 news threshold value for the second player account to be higher, such as $1000. As a result, the system would only notify the second player account, via the chat console, if a player on the network wagering venue had a win of $1000 or more. At the same time, however, the system can still present news events, for the first player account, at the original news threshold value of $500 or more. Therefore, an event win value of $640 would comply with the default pre-set news threshold value for the first player account but not with the modified news threshold value for the second player account. The system can thus present the news message of the $640 win to the first player account, via an instance of the gaming chat console associated with the first player account, but at the same time suppress, or refrain from presenting, the news message of the $640 win to the second player account.

In another embodiment, the system can determine that the first player's activity merits the assignment of a second modified threshold value for the first player account. The second modified threshold value, for the first player account, may have an opposite impact of the first modified threshold value for the second player account. In other words, the first player account may have a betting average of only $0.50, which does not meet the default betting average of $1 or more set by the system. The system can have a second pre-determined news modification value that lowers the pre-set news threshold value for players whose bet averages are less than $1. As a result, the system can assign the additional modified threshold value to the first player, which lowers the news threshold value to be less than $500, perhaps $100. As a result, the first player account will receive news messages for wins over $100 where the second player account receives news messages for wins over $1000.

In some embodiments, a casino operator can configure the system to automatically adjust presentation requirements for news events. For example, in FIG. 4 a wagering game system ("system") 400 includes a configuration server 440 connected to a wagering game server 450 via a communications network 422. The configuration server 440 can present a configuration interface 402 that presents controls for configuring news threshold requirement settings 404 and news threshold modifier settings 430. The news threshold requirement settings 404 can include, for example, a first requirement control 408 for setting a required threshold percentage value that relates to an increase in percentage of a progressive jackpot. A casino operator can use the first requirement control 408 to set the required percentage value so that when a progressive jackpot increases the required percentage indicated by the first requirement control 408, the wagering game server 450 can provide news messages in player chat consoles. A second requirement control 410 can be used instead of, or in addition to, the first requirement control 408. The second requirement control 410, however, sets a required numerical dollar amount versus a required percentage. The news threshold requirement settings 404 can also include a third requirement control 414 for setting a default required dollar amount of wins for slot games, where the default required dollar amount triggers a news event on the system 400. The news threshold requirement settings 404 can include multiple requirement controls for different games based on game type, game titles, game manufacturers, etc. The news threshold requirement settings 404 can also refer to group games and/or tournaments. For example, the news threshold requirement settings 404 includes required group event controls 418 for indicating specific required group game events that trigger the production of news messages on the system 400.

The news threshold modifier settings 430, on the other hand, include controls that specify conditions that, when met, modify the requirements specified in the news threshold requirement settings 404. The news threshold modifier settings 430 can include, for example, a site activity factor control 432 that indicates that site activity is a factor for which news threshold values can be modified. The news threshold modifier settings 430 can include a site activity metric control 434 for setting a statistical measurement value, or metric, to which a player's statistics can be measured, or compared. For example, as described further above, a player's activity, as measured by player statistical values, can affect the news thresholds so that the system 400 can customize required news events thresholds for individual players and/or groups of players. One of the factors can be site activity. Thus, for example, if a site login activity increases or decreases by a first amount (e.g., 5% variance indicated in the site activity metric control 434), then the system 400 can modify one or more of the news threshold requirement settings 404 by a second amount (e.g., increase or decrease by 10% indicated in a first news threshold modifier control 444). Some of the news threshold modifier settings 430 can be related to groups of player accounts whereas others can be related to individual player accounts. For example, a group bet-average factor control 433 can specify that the system 400 will monitor group bet averages for a gaming venue website as a factor that can modify news threshold requirements. If the group bet average increases or decreases by a first amount (e.g., 20% variance indicated in the group bet-average metric control 436), then the system 400 can modify one or more of the news threshold requirement settings 404 by a second amount (e.g., increase or decrease by 4% indicated in a second news threshold modifier control 442). In another example, however, an individual bet-average factor control 438 can specify that the system 400 will monitor individual player account bet averages for a gaming venue website as a factor that can modify news threshold requirements. If an individual player account's bet average increases or decreases by a first amount (e.g., 1% variance indicated in the individual bet-average metric control 439), then the system 400 can modify one or more of the news threshold requirement settings 404, for the individual player account, by a second amount (e.g., increase or decrease by 1% indicated in a third news threshold modifier control 449). As an example, for every $1 that a player account's average bet value increases, the system 400 can increase news presentation requirements by $50, which suppresses more messages in the player's chat console. In another example, however, the player account may desire to receive more messages. In such an example, the system 400 can decrease news presentation requirements by $50. The system 400 can look at player preferences stored in the player account to determine whether the player desires to have the news presentation requirements increased or decreased.

Returning to FIG. 3, in some embodiments, the system can use player settings to determine and automatically modify news threshold requirements. For example, the system can determine that a player account logs on to a network wagering venue to participate in a wagering game session. The system can read player account presentation criteria regarding presentation of the wagering game news event. For example, the system can read preference settings that the player account has set indicating types of events the player considers to be newsworthy of presentation in a chat console. The system can read the preference settings and use them to determine news events that the system can present to the player account via a chat console. For example, the system can determine when a wagering game event occurs and determine descriptive information (e.g., metadata, tags, type information, etc.) associated with the wagering game event. The descriptive information describes the wagering game event. The system can compare the descriptive information from the wagering game event to the player account presentation criteria to determine a match. The system can present the wagering game event as a news message in a chat console if the descriptive information and the player account presentation criteria match.

Some examples of player account presentation criteria may include filters and toggles. The filters can filter the delivery of content based on content type. The news items can have tags describing the content types. The player preferences indicate the types and the system filters based on the types. In some embodiments, the filters can push news messages out to different mediums (e.g., to chat, to email, to social network sites), etc. Toggles, for example, can hide new messages (e.g., hide and show, hide based on type, etc.). In FIG. 1, for example, the GUI 101 may also include options 110 for modifying presentation of news events. For example, the chat console 106 may include toggles 112, 114, and 116. The toggle 116, for instance, can hide and show news events. When a player toggles off the toggle 116, the news event 125, and any other news events from the moderator bot 104 and/or other bots (e.g., from the game bot 149) may hide, or disappear, from view within the chat console 106. When a player toggles off the toggle 112, the system 100 can hide all regular chat items that are presented by the chat social contacts 145. In some embodiments, the system 100 can provide controls and settings for the player to select preferences for what the player considers to be news events versus chat events. The toggle 114 is related to a "following" feature, which is described further below.

Other examples of player account presentation criteria may include settings that relate to a rate of delivery for news messages. For instance, a player account can specify a rate of deliver (e.g., fast, slow, periodically, etc.) or alters requirements for content delivery, based on player preference (e.g., player thresholds that set a delivery speed for the news events). The system can also include controls for presentation display configurations, such as split screens, indentations, columns, text, highlighting, and other visual configurations that alter the way the news messages look.

In some embodiments, the player account presentation criteria can be statistical values representing a player account's wagering activity. The statistical values can be related to a betting amount for a player, a betting average for a player, an amount of player status points, a degree of player activity, a degree of player chat participation, or any other activity that a player can perform on a network wagering venue. In some embodiments, the system can generate marketing messages within a chat console. For example, the system can present advertisements or offers that offer discounts on games based on player history or preference. The system can determine overall coin-in for a player account and can determine an amount of coin-in that the player account is below average. The system can offer sponsored games to the player account to encourage additional coin-in. The system can push out news items that are sponsored by a company. In some embodiments, the system can produce news messages with effects that distinguish them as sponsored news messages (e.g., highlighting, different colors, specific animations, fonts that match a sponsors branding, etc.).

The flow 300 continues at processing block 308, where the system receives textual chat game commands communicated to an interactive game bot and controls a wagering game via the textual chat game commands. For example, in FIG. 1, the system 100 can accept text line entries entered into the chat console 106. The game bot 149 offers an invitation chat message 124 ("Wanna play ACE?") to play the Zeus wagering game. The player account can enter chat codes that use special characters or phrases representative of a specific wagering game function (e.g., a reel spin function, a spin repeat function, a game bet function, a bet multiplication function, a card split function, a card fold function, a cash-in function, a cash-out function, and a game quit function, etc.). For example, the system 100 can use the special characters or phrases to control the Zeus game associated with the game bot 149. For example, the player can respond to the invitation chat message 124 by typing in a "/s" followed by hitting the Enter key on a keyboard. The system 100 can respond to the textual command by spinning the animated slot reels 107 once. In another example, the player can type in "/d" and hit Enter, and the system 100 could present a double up queue. In another example, the player can type "/auto" followed by a number, and the system 100 could respond by spinning the animated slot reels 107 the number of times for the number entered. In other examples, the system 100 can present a game within the chat console 106 that responds to the textual commands. For example, the player account can enter an auto-spin textual command 126 (i.e., "/auto 10 $1"). The system 100 can present images within the chat console 106. For example, the system 100 presents a spin result message 128 showing a spin result of five images (e.g., two lightning bolts emoticons followed by three triton emoticons). The images can appear as text, symbols, etc. The system 100 can also present anticipation images that appear one at a time as a reel line fills out in the chat console 106 (e.g., a flash image for each reel element that appears as the reel elements stop in sequence). The spin result can refer to a reel combination from a pay-table for the Zeus game that results in a win (e.g., 3000 credits), which the system 100 can also present in the spin result message 128. The moderator bot 104 can also present a news message 130 if the spin result is for a win amount that meets a news event threshold. The auto-spin textual command 126 can follow-up with nine additional game spins (because of the "10" value in the "/auto 10 $1" text entry). The chat console 106 can present additional messages that accompany spin results (e.g., status messages for the auto-spin textual command such as "now playing game one of ten," "now playing game two of ten," etc.). The system 100 can determine a bet value associated with the player account. For example, the system 100 can refer to the "$1" value in the "/auto 10 $1" text entry as a bet amount specified by the player account. In other embodiments, the system 100 can use a bet value indicated by the bet meter 132. In other embodiments, the system 100 can use a pre-set bet amount in the player account's settings. The system 100 can electronically transact the bet for the player account with the account server 170. The system 100 can use the bet value in determining a wagering game outcome for the wagering game round, such as a win payout amount that is based on a bet amount. In some embodiments, the system 100 can refer to player preferences to decipher special characters (e.g., refer to special characters defined in the player account profile or preferences). The player account profile or preferences can specifically list custom player inputs, characters, phrases, key strokes, hot keys, etc. that refer to wagering game functions. For example, a player who likes the phrase "boom goes the dynamite" can configure their customized phrase for spinning to be "/bgtd." In another example, a player can customize hot keys (e.g., F1-F12, Ctrl+ key, etc.) to perform sets of activities (e.g., Ctrl+1 can mean to select a certain game and spin 10 times, an arrow down can repeat instruction, etc.). The system 100 can also present a message in the chat console 106 that indicates the hot key selected, and require a confirmation by hitting another key, such as hitting the Enter key to send in the textual game command.

In some embodiments, the system 100 can present functionality for players to play head-to-head against each other. For example, a player can challenge other players to compete in a crossword game. Certain words or phrases in the crossword game can yield different monetary amounts or multipliers. In some embodiments, an opponent can start filling out a word or phrase out and the player can steal it.

The flow 300 continues at processing block 310, where the system follows chat activity for the selected chat social-contacts associated with the player account. For example in FIG. 5, a wagering game system ("system") 500 includes a client device (e.g., computer 537) connected to a wagering game server 550 via a communications network 522. The computer 537 can present a GUI 501 that presents a game interface 503. The GUI 501 can also present a chat console 506 with the followers menu 540. The followers menu 540 can present selectable chat social-contact representations and selection mechanisms for selecting the selectable chat social-contact representations. The selection mechanisms can be clickable controls (e.g., social contact links 525, 527, 529, 532, and 534), menus, keys or other player input mechanism. The social contact links 525, 527, 529, 532, and 534 represent additional player accounts for which the player account desires to view, or follow, chat activity. A player account (e.g., the Marcus Miller/"Ace" player account logged on to a game session through the game interface 503) can select any of the social contact links 525, 527, 529, 532, and 534 and perform activities related to social contacts associated with the social contact links 525, 527, 529, 532, and 534.

The followers menu 540 can be divided into two major sections including a following section 521 and a followers section 523. The following section 521 can be a list, or group, of social contact accounts that the player account is following, or in other words, for which the player account desires to view chat messages and other electronic social communications. In some embodiments, the social contact accounts being followed may be spread across different chat rooms on the network wagering venue. However, the player account that is following the social contact accounts can see the social contacts' chat messages (e.g., the contacts' sides of chat conversations) no matter what chat room the social contact accounts are logged into at the time. The chat messages from the followed social contact accounts can feed into a chat console (e.g., a chat client window) that the player account is using at the time that the followed social contact accounts transmit their chat messages.

The followers section 523 can be a list of social contacts that are following the player account. The social contact can also have wagering game player accounts that are linked to the player account (e.g., are linked to the Marcus Miller/"Ace" player account). The system 500, thus, can also present an instance of the chat console 506 to the social contact. The instances of the chat console 506 presented to the social contacts, however, would list names that the social contacts selected to follow or that were following the social contacts.

In one embodiment, the system 500 assigned the social contact links 525 and 527 to the following section 521 when the player account (e.g., the Marcus Miller/"Ace" player account) selected social contact representations (e.g., buddy names) from a chat contact interface 508 (e.g., a buddy list). The social contact links 529, 532, and 534 can appear in the followers section 523 when the player account (e.g., the Marcus Miller/"Ace" account) is selected by other player accounts. One social contact link 527 (i.e., for the social contact account "WhoDidWhatWhere"), in the following section 521, can include an interactive dropdown menu 536 that appears when a player selects (e.g., mouse over+clicks) the social contact link 527. The interactive dropdown menu 536 can include various options that the player can apply to the social contact account that the player account is following. Another social contact link 534 (i.e., for the social contact account "SillyRabbit"), in the followers section 523, can include an interactive dropdown menu 539 that appears when a player selects the social contact link 534. The interactive dropdown menu 539 can include various options that the player can apply to the social contact account that is following the player account. Some examples of options that can appear specifically in the interactive dropdown menu 536 in the following section 521 can include options to: (1) stop following, (2) see all chat for the social contact, (3) see all chat in context (i.e., show the chat messages from other users in a room that the social contact is chatting in), and (4) challenge to compete in a head-to-head game (e.g., could include a feature to pay in a certain amount to compete with the social contact), etc. Some examples of options that can appear specifically in the interactive dropdown menu 539 in the followers section 523 can include options to: (1) follow the follower as well, (2) block the follower from following the user, (3) accept invitations to compete in a head-to-head game, etc. Some examples of options can appear in either the interactive dropdown menu 536 and/or the interactive dropdown menu 539 can include options to: (1) send a whisper (i.e., a private message), (2) see the social contact's profile, (3) present video replay feeds of the social contact's wagering game activity (e.g., could be a graphical link to the video content), (4) embed video content (e.g., could use a thumbnail image of video and, when activated, display video in a chat feed window or pop-up in a main window), (5) be alerted of a certain game being played by the social contact, (6) challenge to a head-to-head competition, (7) self-invite to the social contact's game, (8) etc.

In some embodiments, the system 500 can combine player accounts and chat social contacts, and their chat messages, into a single chat room. In other embodiments, the system 500 can separate, or segregate, player accounts and chat contacts into different chat rooms. In some embodiments, the system 500 can duplicate instances of a chat object that represent the player account and place chat object into different chat rooms. The system 500 can also aggregate chat comments, and/or news messages, from the different chat rooms into a single chat console for the player account. For example, the system 500 can determine that the player account is chatting in a first chat room via a chat room console. The system 500 can also determine that a followed social contact is in a second chat room separate from the first chat room. The system 500 can determine that the followed social contact makes chat messages while chatting in the second chat room. The system 500, however, can present the chat messages for the followed social contact to the player account via the chat room console for the first chat room.

The flow 300 continues at processing block 312, where the system integrates chat activity with client applications, and social network functions. For example, in FIG. 6, a wagering game system 600 includes a computer 637 connected to a web server 680, a wagering game server 650, and a chat server 640 via a communications network 622. The computer 637 can present a GUI 602. The GUI 602 can include a browser application 604 that presents a website 690 for a network wagering venue, hosted by the web server 680. The web server 680 can work in conjunction with the wagering game server 650 to present wagering game content on the website 690. The website 690 can include wagering game components (e.g., reels or other game play elements, credit meters, bet meters, game controls, etc.). The website 690 can also integrate a third party chat client 606 (e.g., Yahoo® Messenger™, MySpaceIM™, AIM®, ICQ®, Skype™, Pidgin™, Trillian™, etc.) as a plug-in to the browser application 604. In other embodiments, the third party chat client 606 can function as a stand-alone application on the computer 637. The third party chat client 606 can communicate with the chat server 640 to communicate chat messages.

In some embodiments, the third party chat client 606 can launch a chat console 612. The chat console 612 can include a list of social contacts (e.g., buddy list 616). Some of the social contacts, such as social contacts 621, can be for social network accounts that are linked to, or acquainted with, a user account 614. The user account 614 can be a chat account, or other social network account, that communicates with the chat server 640 via the chat console 612.

Some of the social contacts, such as social contact 623, can represent game bots (e.g., the social contact 623 is associated with a game bot for the Zeus game). The user account 614 can use the chat console 612 to play wagering games using textual commands. For example, the social contact 623, or more particularly, the game bot associated with the social contact 623, can send a first message 646 to the user account 614 to play the Zeus game via the chat console 612. The user account 614 can generate a second message 647 that includes a textual command, with special characters or phrases that control the Zeus game via the chat console 612. When the game bot receives a textual command, the game bot can connect the user account 614, if not already connected, to an associated player account for the user account 614. For instance, the game bot can logon the player account to an account server associated with the wagering game server 650. The player account links the user account 614 to the wagering game server 650 so that the user account 614 can provide game commands, which the wagering game server 650 can process. The wagering game server 650 can receive the textual command in the second message 647, decipher the textual command's meaning, and process the textual command. For example, the second message 647 includes special characters that the wagering game server 650 deciphers as a command to spin the Zeus game once with a $1 bet. The wagering game server 650 generates a game result for the Zeus game, for the one spin, and sends a third message 648 that indicates a game result for the one spin. The wagering game server 650 can send and receive the messages via the chat server 640. The wagering game server 650 can transact the bet and/or any winnings from, or to, the user account 614. In some embodiments, textual commands can launch a wagering game application (e.g., bring up a flash application of a wagering game), control the wagering game application, close the wagering game application, etc.

In some embodiments, the third party chat client 606 can include a gaming toolbar 641 that can be used instead of, or in conjunction with, textual commands. The gaming toolbar 641, for instance, can include a first button 642 configured to present player account information and a second button 644 configured to present gaming content. For example, activation of the second button 644 can integrate with and control a game client 610 stored on the computer 637 and/or served as a server-based application by the wagering game server 650. The gaming toolbar 641 can be a plug-in to the third party chat client 606, which presents the gaming toolbar 641 below chat functionality of the third party chat client 606. The chat console 612 can also include a chat room console 618 which the player account can use to access game related chat rooms (e.g., Zeus' Throne Room) and non-game-related chat rooms (e.g., Chuckle Hut). In some embodiments, the system 600 can integrate the chat features with gaming text commands into another casino website's chat or social network's applications. The system 600 can also integrate the chat features with other local applications.

In some embodiments, the system 600 can include a keystroke watcher application 608. The keystroke watcher application 608 can be a plug-in embedded in the third party chat client 606, or any other local software application, that watches for specific key-stroke combinations by the player, or other similar player configured inputs that initiate gaming functionality. The keystroke watcher application 608 can watch for pre-configured gaming keystrokes that are activated by the user of the computer 637. Once the keystroke watcher application 608 detects a gaming keystroke, the keystroke watcher application 608 coordinates with the wagering game server 650 to enable the wagering functionality. The keystroke watcher application 608 can also plug into, and track keystrokes from, any application that runs on the computer 637.

In some embodiments, the system 600 can integrate chat features, contact lists, etc., from different chat clients, social network platforms, etc. For example, the system 600 can integrate contacts from different chat clients (e.g., Yahoo Messenger) and/or social networks websites (e.g., Facebook™) into a single chat console.

In some embodiments, the system 600 can send wins, bonuses, and referrals through the third party chat client 606. The system 600 can solicit referrals through the chat console 612 (e.g., via a chat message 649). The system 600 can use the game bot associated with the social contact 623 to send the chat message 649.

Additional Example Operating Environments

This section describes example operating environments, systems and networks, and presents structural aspects of some embodiments.

Wagering Game Computer System

Figure 7:
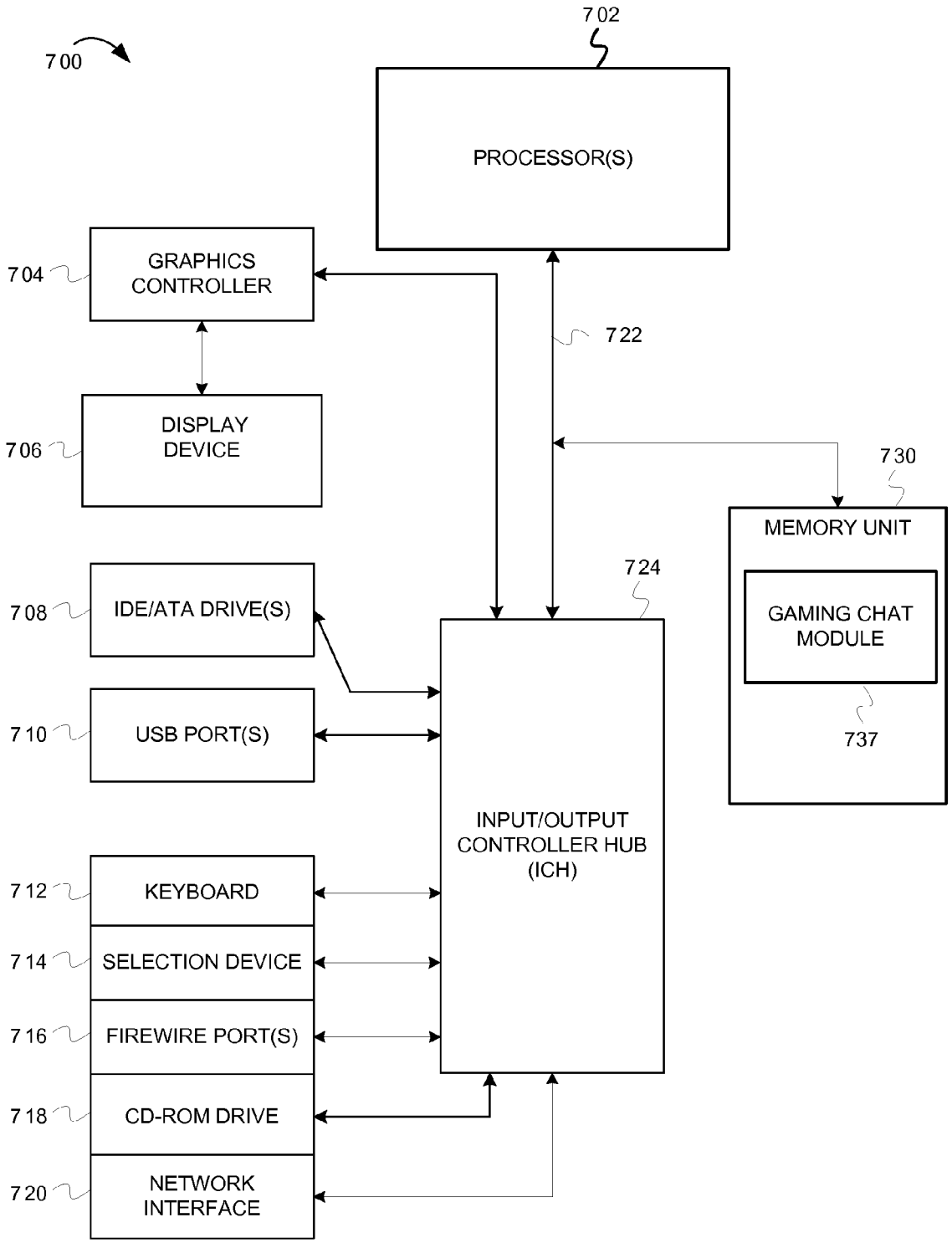
FIG. 7 is an illustration of a wagering game computer system 700, according to some embodiments.

FIG. 7 is a conceptual diagram that illustrates an example of a wagering game computer system 700, according to some embodiments. In FIG. 7, the computer system 700 may include a processor unit 702, a memory unit 730, a processor bus 722, and an Input/Output controller hub (ICH) 724. The processor unit 702, memory unit 730, and ICH 724 may be coupled to the processor bus 722. The processor unit 702 may comprise any suitable processor architecture. The computer system 700 may comprise one, two, three, or more processors, any of which may execute a set of instructions in accordance with some embodiments.

The memory unit 730 may also include an I/O scheduling policy unit 7 and I/O schedulers 7. The memory unit 730 can store data and/or instructions, and may comprise any suitable memory, such as a dynamic random access memory (DRAM), for example. The computer system 700 may also include one or more suitable integrated drive electronics (IDE) drive(s) 708 and/or other suitable storage devices. A graphics controller 704 controls the display of information on a display device 706, according to some embodiments.

The input/output controller hub (ICH) 724 provides an interface to I/O devices or peripheral components for the computer system 700. The ICH 724 may comprise any suitable interface controller to provide for any suitable communication link to the processor unit 702, memory unit 730 and/or to any suitable device or component in communication with the ICH 724. The ICH 724 can provide suitable arbitration and buffering for each interface.

For one embodiment, the ICH 724 provides an interface to the one or more IDE drives 708, such as a hard disk drive (HDD) or compact disc read only memory (CD ROM) drive, or to suitable universal serial bus (USB) devices through one or more USB ports 710. For one embodiment, the ICH 724 also provides an interface to a keyboard 712, selection device 714 (e.g., a mouse, trackball, touchpad, etc.), CD-ROM drive 718, and one or more suitable devices through one or more firewire ports 716. For one embodiment, the ICH 724 also provides a network interface 720 though which the computer system 700 can communicate with other computers and/or devices.

The computer system 700 may also include a machine-readable medium that stores a set of instructions (e.g., software) embodying any one, or all, of the methodologies for integrate chat and wagering games. Furthermore, software can reside, completely or at least partially, within the memory unit 730 and/or within the processor unit 702. The computer system 700 can also include a gaming chat module 737. The gaming chat module 737 can process communications, commands, or other information, to integrate chat and wagering games. Any component of the computer system 700 can be implemented as hardware, firmware, and/or machine-readable media including instructions for performing the operations described herein.

Personal Wagering Game System

Figure 8:
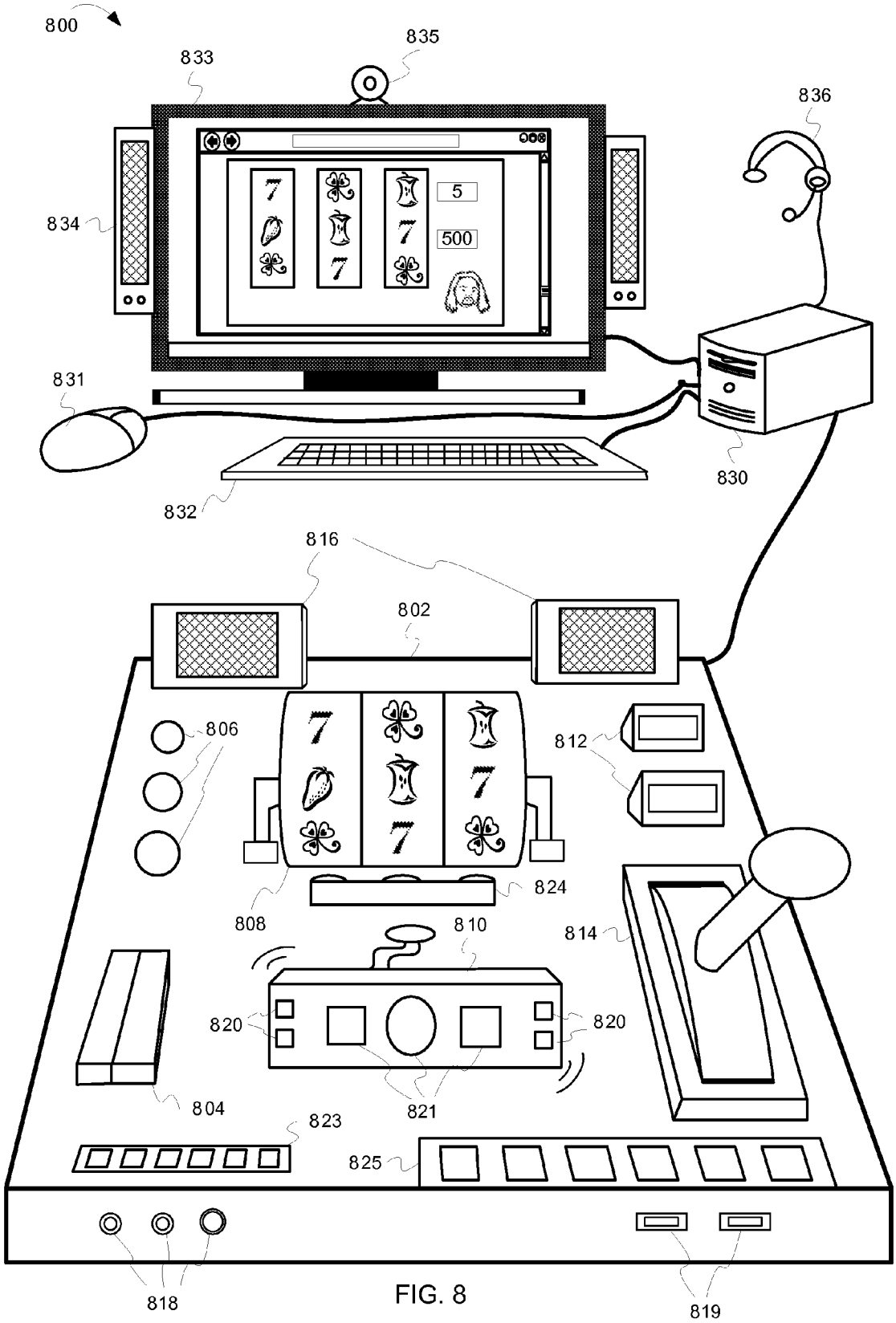
FIG. 8 is an illustration of a personal wagering game system 800, according to some embodiments.

FIG. 8 is a conceptual diagram that illustrates an example of a personal wagering game system 800, according to some embodiments. In FIG. 8, the personal wagering game system ("system") 800 includes an exemplary computer system 830 connected to several devices, including user input devices (e.g., a keyboard 832, a mouse 831), a web-cam 835, a monitor 833, speakers 834, and a headset 836 that includes a microphone and a listening device. In some embodiments, the webcam 835 can detect fine details of a person's facial features, from an eye-level perspective. The web-cam 835 can use the fine detail to determine a person's identity, their demeanor, their facial expressions, their mood, their activities, their eye focus, etc. The headset 836 can include biometric sensors configured to detect voice patterns, spoken languages, spoken commands, etc. The biometric sensors in the web-cam 835 can detect colors (e.g., skin colors, eye colors, hair colors, clothing colors, etc.) and textures (e.g., clothing material, scars, etc.). The biometric sensors in the web-cam 835 can also measure distances between facial features (e.g., distance between eyes, distance from eyes to nose, distance from nose to lips, length of lips, etc.). The system 800 can generate a facial and body map using the detected colors, textures, and facial measurements. The system 800 can use the facial and body map to generate similar facial features and body appearances for a player account avatar. Also connected to the computer system 830 is a gaming control device ("gaming pad") 802 including wagering game accoutrements associated with wagering games. The wagering game accoutrements include one or more of prop reels 808, prop game meters 812, indicators 806, a game control device 810, a physical lever 814, a magnetic card reader 804, a video projection device 824, input/output ports 818, USB ports 819, and speakers 816. The gaming pad 802 can present feedback of online activities. For instance, the gaming pad 802 can use vibrations and signals on the gaming control device (e.g., the game control device 810 or the physical level 814 can vibrate to indicate a back pat from another player or a game celebration, the indicators 806 can blink, etc.). The physical lever 814 can produce feelings in the lever to emulate a pulling feel or a vibration. The video projection device 824 can project video onto the props reels 808 so that the prop reels 808 can present many different types of wagering games. The prop reels 808 can spin when the physical lever 814 is pulled. The video projection device 824 can project reel icons onto the prop reels 808 as they spin. The video projection device 824 can also project reel icons onto the prop reels 808 when the prop reels 808 are stationary, but the imagery from the video project device 824 makes the prop reels 808 appear to spin. The magnetic card reader 804 can be used to swipe a credit card, a player card, or other cards, so that the system can quickly get information. The system 800 can offer lower rates for using the magnetic card reader 804 (e.g., to get a lower rate per transaction). The game control device 810 can include an emotion indicator keypad with keys 820 that a player can use to indicate emotions. The game control device 810 can also include biometric devices 821 such as a heart-rate monitor, an eye pupil dilation detector, a fingerprint scanner, a retinal scanner, voice detectors, speech recognition microphones, motion sensors, sound detectors, etc. The biometric devices 821 can be located in other places, such as in the headset 836, within a chair (not shown), within personal control devices (e.g. joysticks, remote controls, game pads, roller-balls, touch-pads, touch-screens, etc.), within the web-cam 835, or any other external device. The external devices can be connected to the computer 830 or to the game control device 810 via the input/output ports 818. As a security feature, some biometric devices can be associated with some of the gaming pad devices (e.g., the magnetic card reader 804), such as a fingerprint scanner, a retinal scanner, a signature pad to recognize a player's signature, etc. The game control device 810 can also use the keys 820 to share items and control avatars, icons, game activity, movement, etc. within a network wagering venue. The game pad can also have an electronic (e.g., digital) button panel 825, an electronic control panel 823, or any other type of changeable panel that can change appearance and/or configuration based on the game being played, the action being performed, and/or other activity presented within an online gaming venue. The game control device 810 can also move in different directions to control activity within the online gaming venue (e.g., movement of a player's avatar moves in response to the movements of the game control device 810). Avatars can be pre-programmed to act and look in certain ways, which the player can control using the system 800. The gaming pad 802 can permit the player to move the avatar fluidly and more easily than is possible using a standard keyboard. The system 800 can cause an avatar to respond to input that a player receives via the gaming pad 802. For example, a player may hear a sound that comes primarily from one direction (e.g., via stereophonic signals in the headset 836) within the network wagering venue. The system 800 can detect the movement of the player (e.g., the system 800 detects that a player moves his head to look in the direction of the sound, the player uses the game control device 810 to move the avatar's perspective to the direction of the sound, etc.). The system 800 can consequently move the avatar's head and/or the avatar's perspective in response to the player's movement. The player can indicate an expression of an emotion indicated by the player using the keys 820. The system 800 can make the avatar's appearance change to reflect the indicated emotion. The system 800 can respond to other movements or actions by the player and fluidly move the avatar to respond. The system 800 can also interpret data provided by the biometric devices and determine expressions and/or indications of emotions for a player using the system 800.

Wagering Game Machine Architecture

Figure 9:
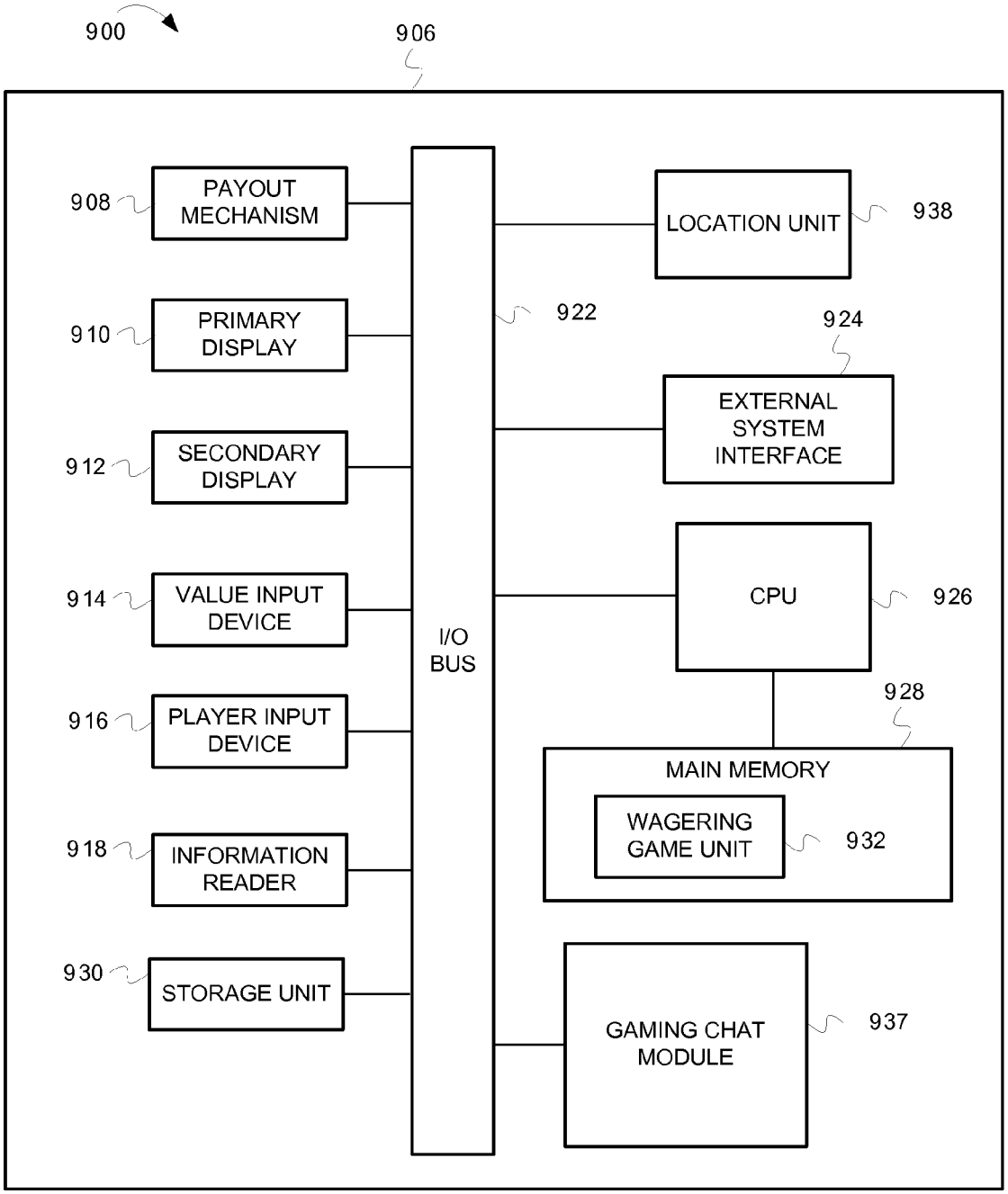
FIG. 9 is an illustration of a wagering game machine architecture 900, according to some embodiments.

FIG. 9 is a conceptual diagram that illustrates an example of a wagering game machine architecture 900, according to some embodiments. In FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game unit 932. In some embodiments, the wagering game unit 932 can present wagering games, such as video poker, video black jack, video slots, video lottery, reel slots, etc., in whole or part.

The CPU 926 is also connected to an input/output ("I/O") bus 922, which can include any suitable bus technologies, such as an AGTL+frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems (e.g., wagering game networks). The external system interface 924 can include logic for exchanging information over wired and wireless networks (e.g., 802.11g transceiver, Bluetooth transceiver, Ethernet transceiver, etc.)

The I/O bus 922 is also connected to a location unit 938. The location unit 938 can create player information that indicates the wagering game machine's location/movements in a casino. In some embodiments, the location unit 938 includes a global positioning system (GPS) receiver that can determine the wagering game machine's location using GPS satellites. In other embodiments, the location unit 938 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 9, in some embodiments, the location unit 938 is not connected to the I/O bus 922.

In some embodiments, the wagering game machine 906 can include additional peripheral devices and/or more than one of each component shown in FIG. 9. For example, in some embodiments, the wagering game machine 906 can include multiple external system interfaces 924 and/or multiple CPUs 926. In some embodiments, any of the components can be integrated or subdivided.

In some embodiments, the wagering game machine 906 includes a gaming chat module 937. The gaming chat module 937 can process communications, commands, or other information, where the processing can integrate chat and wagering games.

Furthermore, any component of the wagering game machine 906 can include hardware, firmware, and/or machine-readable media including instructions for performing the operations described herein.

Mobile Wagering Game Machine

Figure 10:
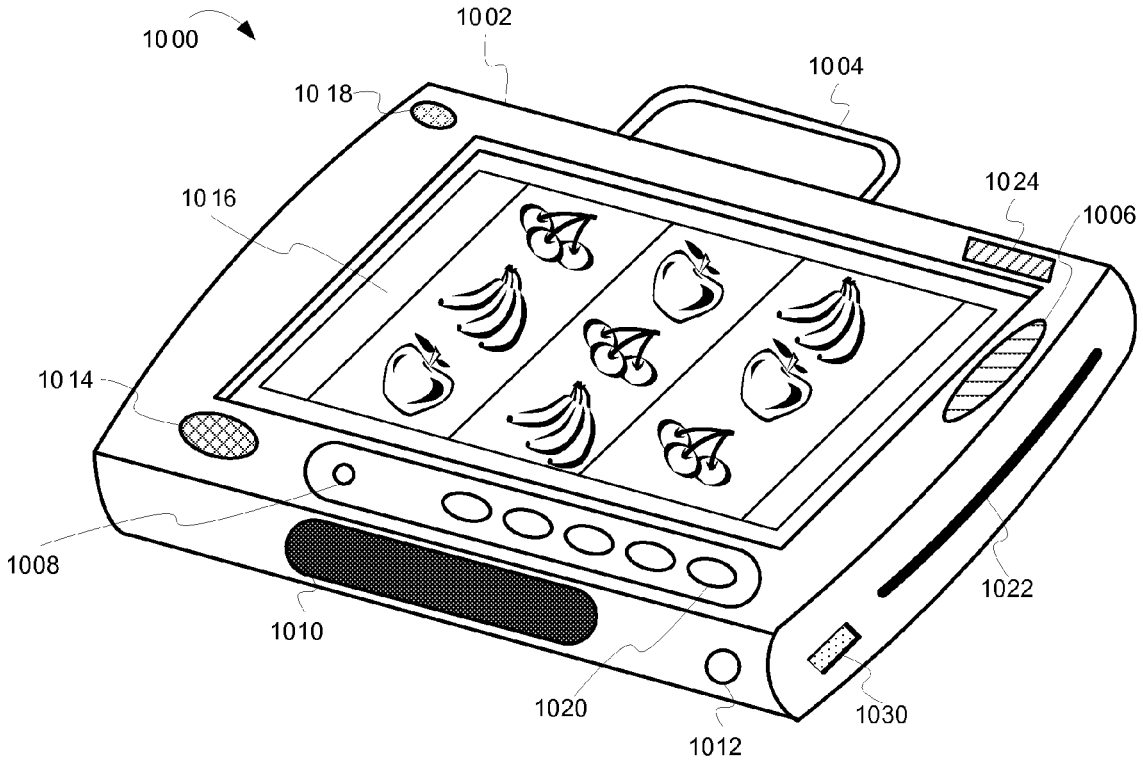
FIG. 10 is an illustration of a mobile wagering game machine 1000, according to some embodiments.

FIG. 10 is a conceptual diagram that illustrates an example of a mobile wagering game machine 1000, according to some embodiments. In FIG. 10, the mobile wagering game machine 1000 includes a housing 1002 for containing internal hardware and/or software such as that described above vis-à-vis FIG. 9. In some embodiments, the housing has a form factor similar to a tablet PC, while other embodiments have different form factors. For example, the mobile wagering game machine 1000 can exhibit smaller form factors, similar to those associated with personal digital assistants. In some embodiments, a handle 1004 is attached to the housing 1002. Additionally, the housing can store a foldout stand 1010, which can hold the mobile wagering game machine 1000 upright or semi-upright on a table or other flat surface.

The mobile wagering game machine 1000 includes several input/output devices. In particular, the mobile wagering game machine 1000 includes buttons 1020, audio jack 1008, speaker 1014, display 1016, biometric device 1006, wireless transmission devices (e.g., wireless communication units 1012 and 1024), microphone 1018, and card reader 1022. Additionally, the mobile wagering game machine can include tilt, orientation, ambient light, or other environmental sensors.

In some embodiments, the mobile wagering game machine 1000 uses the biometric device 1006 for authenticating players, whereas it uses the display 1016 and the speaker 1014 for presenting wagering game results and other information (e.g., credits, progressive jackpots, etc.). The mobile wagering game machine 1000 can also present audio through the audio jack 1008 or through a wireless link such as Bluetooth.

In some embodiments, the wireless communication unit 1012 can include infrared wireless communications technology for receiving wagering game content while docked in a wager gaming station. The wireless communication unit 1024 can include an 802.11G transceiver for connecting to and exchanging information with wireless access points. The wireless communication unit 1024 can include a Bluetooth transceiver for exchanging information with other Bluetooth enabled devices.

In some embodiments, the mobile wagering game machine 1000 is constructed from damage resistant materials, such as polymer plastics. Portions of the mobile wagering game machine 1000 can be constructed from non-porous plastics, which exhibit antimicrobial qualities. Also, the mobile wagering game machine 1000 can be liquid resistant for easy cleaning and sanitization.

In some embodiments, the mobile wagering game machine 1000 can also include an input/output ("I/O") port 1030 for connecting directly to another device, such as to a peripheral device, a secondary mobile machine, etc. Furthermore, any component of the mobile wagering game machine 1000 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

determining a win amount associated with a win event that occurs for a wagering game during a wagering game session;

determining a degree of wagering associated with one or more player accounts logged on to a wagering game network when the win event occurs;

automatically, via at least one of one or more processors, adjusting a threshold requirement for the win amount based on the degree of wagering, wherein the threshold requirement indicates a required amount of monetary value that the win event must comply with for the win event to be eligible for announcement as a news message;

comparing, via at least one of the one or more processors, the win amount to the threshold requirement after automatically adjusting the threshold requirement based on the degree of wagering; and determining, via at least one of the one or more processors, a degree of presentation of the news message to provide to the one or more player accounts based on the comparing.

2. The computer-implemented method of claim 1, wherein the degree of wagering is one or more of a statistical betting average and a rate of betting activity for the one or more player accounts over a period.

3. The computer-implemented method of claim 1, wherein the automatically adjusting the threshold requirement comprises, determining that the win amount complies with the threshold requirement; and automatically decreasing the threshold requirement proportional to an increase in the degree of wagering.

4. The computer-implemented method of claim 1 wherein the automatically adjusting the threshold requirement comprises automatically modifying the threshold requirement by a modification value specified in a setting associated with a chat application.

5. The computer-implemented method of claim 1, wherein the determining the degree of presentation of the news message to provide to the one or more player accounts based on the comparing comprises:

determining, based on the comparing, that the win amount does not comply with the threshold requirement; and suppressing presentation of the news message in response to determining that the win amount does not comply with the threshold requirement.

6. The computer-implemented method of claim 1 further comprising:

determining, from at least one of the one or more player accounts, a player preference for either increasing or decreasing the degree of presentation of the news message; and modifying the degree of presentation according to the player preference.

7. An apparatus comprising:

means for determining a win amount associated with a win event that occurs for a wagering game during a wagering game session;

means for determining a degree of chat activity associated with one or more player accounts logged on to a wagering game network when the win event occurs;

means for automatically adjusting a threshold requirement for the win amount based on the degree of chat activity, wherein the threshold requirement indicates a required amount of monetary value that the win event must comply with for the win event to be eligible for announcement via one or more news messages;

means for comparing the win amount to the threshold requirement after automatically adjusting the threshold requirement based on the degree of chat activity;

means for determining, based on the comparing, that the win amount complies with the threshold requirement; and means for modifying presentation of the one or more news messages via a chat application in response to the determining that the win amount complies with the threshold requirement.

8. The apparatus of claim 7 further comprising:

means for filtering the presentation of the one or more news messages according to user preference.

9. The apparatus of claim 7, wherein the means for modifying the presentation of the one or more news messages via the chat application comprises one or more of means for modifying a rate of delivery of the one or more news messages and means for suppressing presentation of at least one of the one or more news messages.

10. The apparatus of claim 7, wherein the means for automatically adjusting the threshold requirement for the win amount based on the degree of chat activity comprises:

means for automatically decreasing the threshold requirement based on an increase in the degree of chat activity.

11. The apparatus of claim 7 further comprising:

means for automatically adjusting the threshold requirement for the win amount based on one or more of a betting amount for the one or more player accounts, a betting average for the one or more player accounts, an amount of player status points possessed by the one or more player accounts, and a degree of player activity of the one or more player accounts.

12. A system comprising:

one or more processors; and one or more memory units configured to store instructions that, when executed by at least one of the one or more processors, cause the system to determine a win amount associated with a win event that occurs for a wagering game during a wagering game session, determine a degree of wagering associated with one or more player accounts logged on to a wagering game network when the win event occurs, automatically adjust a threshold requirement for the win amount based on the degree of wagering, wherein the threshold requirement indicates a required amount of monetary value that the win event must comply with for the win event to be eligible for announcement as a news message, compare the win amount to the threshold requirement after automatic adjustment of the threshold requirement based on the degree of wagering, and determine a degree of presentation of the news message to provide to the one or more player accounts based on comparison of the win amount to the threshold requirement.

13. The system of claim 12, wherein the degree of wagering is one or more of a statistical betting average and a rate of betting activity for the one or more player accounts over a period.

14. The system of claim 12, wherein the instruction to automatically adjust the threshold requirement comprises instructions which, when executed by at least one of the one or more processors, cause the system to determine that the win amount complies with the threshold requirement, and automatically decrease the threshold requirement proportional to an increase in the degree of wagering.

15. The system of claim 12, wherein the instruction to automatically adjust the threshold requirement comprises an instruction which, when executed by at least one of the one or more processors, causes the system to automatically modify the threshold requirement by a modification value specified in a setting associated with a chat application.

16. The system of claim 12, wherein the instruction to determine the degree of presentation of the news message to provide to the one or more player accounts based on the comparison of the win amount to the threshold requirement comprises instructions which, when executed by at least one of the one or more processors, cause the system to determine, based on the comparison of the win amount to the threshold requirement, that the win amount does not comply with the threshold requirement, and suppress presentation of the news message in response to determination that the win amount does not comply with the threshold requirement.

17. The system of claim 12, wherein the one or more memory units include instructions which, when executed by at least one of the one or more processors, further cause the system to determine, from at least one of the one or more player accounts, a player preference for either increasing or decreasing the degree of presentation of the news message; and modify the degree of presentation according to the player preference.

18. One or more non-transitory machine-readable storage media having instructions stored thereon, which when executed by a set of one or more processors causes the set of one or more processors to perform operations comprising:

determining a win amount associated with a win event that occurs for a wagering game during a wagering game session;

determining a degree of chat activity associated with one or more player accounts logged on to a wagering game network when the win event occurs;

automatically adjusting a threshold requirement for the win amount based on the degree of chat activity, wherein the threshold requirement indicates a required amount of monetary value that the win event must comply with for the win event to be eligible for announcement via one or more news messages;

comparing the win amount to the threshold requirement after automatically adjusting the threshold requirement based on the degree of chat activity;

determining, based on the comparing, that the win amount complies with the threshold requirement; and modifying presentation of the one or more news messages via a chat application in response to the determining that the win amount complies with the threshold requirement.

19. The one or more non-transitory machine-readable storage media of claim 18, said operations further comprising:

filtering the presentation of the one or more news messages according to user preference.

20. The one or more non-transitory machine-readable storage media of claim 18, wherein the operation of modifying the presentation of the one or more news messages via the chat application includes an operation comprising one or more of modifying a rate of delivery of the one or more news messages and suppressing presentation of at least one of the one or more news messages.

21. The one or more non-transitory machine-readable storage media of claim 18, wherein the operation of automatically adjusting the threshold requirement for the win amount based on the degree of chat activity includes an operation comprising automatically decreasing the threshold requirement based on an increase in the degree of chat activity.

22. The one or more non-transitory machine-readable storage media of claim 18, said operations further comprising:

automatically adjusting the threshold requirement for the win amount based on one or more of a betting amount for the one or more player accounts, a betting average for the one or more player accounts, an amount of player status points possessed by the one or more player accounts, and a degree of player activity of the one or more player accounts.

* * * * *